US009671152B2

(12) United States Patent
Kim et al.

(10) Patent No.: US 9,671,152 B2
(45) Date of Patent: Jun. 6, 2017

(54) REFRIGERATOR AND MANUFACTURING METHOD THEREOF

(71) Applicant: SAMSUNG ELECTRONICS CO., LTD., Suwon-si, Gyeonggi-do (KR)

(72) Inventors: Ki Youn Kim, Gwangju (KR); Seung Yong Yang, Seoul (KR); Jee Hoon Lee, Goyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/423,345

(22) PCT Filed: Aug. 30, 2013

(86) PCT No.: PCT/KR2013/007826
§ 371 (c)(1),
(2) Date: Feb. 23, 2015

(87) PCT Pub. No.: WO2014/035186
PCT Pub. Date: Mar. 6, 2014

(65) Prior Publication Data

US 2015/0219387 A1 Aug. 6, 2015

(30) Foreign Application Priority Data

Sep. 3, 2012 (KR) ..... 10-2012-0097373

(51) Int. Cl.
*F25D 23/02* (2006.01)
*F25D 23/00* (2006.01)
*F25D 25/00* (2006.01)

(52) U.S. Cl.
CPC ..... *F25D 23/02* (2013.01); *F25D 23/00* (2013.01); *F25D 23/028* (2013.01); *F25D 25/00* (2013.01); *F25D 2323/021* (2013.01)

(58) Field of Classification Search
CPC ..... F25D 23/00; F25D 23/02; F25D 23/028; F25D 25/00; F25D 2323/02;
(Continued)

(56) References Cited

U.S. PATENT DOCUMENTS 2,002,366 A * 5/1935 Eto ..... 220/614
2,171,036 A * 8/1939 Money ..... 52/717.02
(Continued)

FOREIGN PATENT DOCUMENTS

DE 10 2010 039 645 2/2012
IT WO2005085724 A1 * 9/2005 ..... F25D 23/00
(Continued)

OTHER PUBLICATIONS

International Search Report mailed on Dec. 16, 2013 in corresponding International Patent Application No. PCT/KR2013/007826.
Australian Office Action dated Sep. 10, 2015 in corresponding Australian Patent Application No. 2013309684.
Extended European Search Report dated Mar. 17, 2016 from European Patent Application No. 13832410.8, 8 pages.
(Continued)

*Primary Examiner* — Andrew Roersma
(74) *Attorney, Agent, or Firm* — Staas & Halsey LLP

(57) ABSTRACT

Disclosed herein is a refrigerator having a door rotatably hinged to a body of the refrigerator that prevents droop of the door at the side opposite to the axis of rotation of the door. A dyke formed on the rear surface of the door is provided with a roller, which is supported by the bottom surface of the storage compartment. A roller cap having a roller accommodation space to accommodate a part of the roller is connected to the dyke, and the roller is rotatably mounted to the roller cap.

7 Claims, 9 Drawing Sheets

(58) Field of Classification Search
CPC ..... F25D 2323/021; F25D 2323/024; F25D 2400/38; F25D 23/06; F25D 23/065; F25D 23/066; F25D 23/067; F25D 23/069
See application file for complete search history.

(56) References Cited

U.S. PATENT DOCUMENTS

| | | | | | |
|---|---|---|---|---|---|
| 4,142,766 | A * | 3/1979 | Swerbinsky | ..... | 312/406 |
| 5,052,151 | A * | 10/1991 | Inui | ..... | 49/394 |
| 5,143,430 | A * | 9/1992 | Craven et al. | ..... | 312/291 |
| 6,428,130 | B1 * | 8/2002 | Banicevic | ..... | F25D 21/04 312/296 |
| 7,654,107 | B2 * | 2/2010 | Okuda et al. | ..... | 62/441 |
| 2005/0046319 | A1 * | 3/2005 | Chekal et al. | ..... | 312/401 |
| 2007/0138925 | A1 * | 6/2007 | Fu | ..... | 312/401 |
| 2009/0019883 | A1 * | 1/2009 | Haller et al. | ..... | 62/465 |
| 2012/0043874 | A1 * | 2/2012 | Simpson et al. | ..... | 312/408 |
| 2013/0169139 | A1 * | 7/2013 | Jung et al. | ..... | 312/405 |

FOREIGN PATENT DOCUMENTS

| | | | | | |
|---|---|---|---|---|---|
| JP | 2000257327 | A * | 9/2000 | ..... | E05D 15/28 |
| JP | 2000-304418 | | 11/2000 | | |
| JP | 2001349130 | A * | 12/2001 | ..... | F25D 23/02 |
| JP | 2009144417 | A * | 7/2009 | ..... | E05D 15/02 |
| KR | 1019970007232 | A * | 2/1997 | ..... | F25D 23/02 |
| KR | 10-0697076 | | 3/2007 | | |
| KR | 100936381 | B1 * | 1/2010 | ..... | F25D 23/02 |
| WO | 2006/090959 | A1 | 8/2006 | | |
| WO | 2012/025382 | A2 | 3/2012 | | |

OTHER PUBLICATIONS

Canadian Office Action dated Aug. 8, 2016 from Canadian Patent Application No. 2,882,436, 4 pages.
Chinese Office Action dated Nov. 14, 2016 from Chinese Patent Application No. 201380045969.4, 16 pages.
Canadian Notice of Allowance dated Mar. 2, 2017 from Canadian Patent Application No. 2,882,436, 1 page.

* cited by examiner

REFRIGERATOR AND MANUFACTURING METHOD THEREOF

CROSS-REFERENCE TO RELATED APPLICATIONS

This application is a U.S. National Stage Application, which claims the benefit under 35 U.S.C. §371 of PCT International Patent Application No. PCT/KR2013/007826, filed Aug. 30, 2013, which claims the foreign priority benefit under 35 U.S.C. §119 of Korean Application No. 10-2012-0097373 filed Sep. 3, 2012, the contents of which are incorporated herein by reference.

TECHNICAL FIELD

Embodiments of the present invention relate to a refrigerator having a door rotatably hinged to a body of the refrigerator.

BACKGROUND ART

A refrigerator, which generally includes a storage compartment to store food and a cooling unit to supply cool air to the storage compartment, is a home appliance used to keep food fresh. The front of the storage compartment is configured to be open such that the foods are placed in or withdrawn from the storage compartment. The open front is closed by a door that is rotatably hinged to the body of the refrigerator.

The refrigerator is supported by hinges connected to upper and lower portions at one side of the door with respect to a median plane of the door. Accordingly, as the refrigerator continues to be used, the other side of the door to which hinges are not connected may droop due to weight of the door or the food stored in the door pocket provided at the rear surface of the door. The other side of the door may also droop due to standard errors of the door and hinges or errors in connecting the door to the body.

DISCLOSURE

Technical Problem

Droop of the door may degrade the aesthetic quality of the exterior of refrigerator, and may further reduce reliability of a product for users. In addition, a side-by-side type refrigerator having a pair of rotating doors to open and close the storage compartment or a French door refrigerator may fail to retain cool air inside due to malfunction of a filler to seal the gap between the left and right doors.

Accordingly, ways to prevent droop of the door is being sought for all types of refrigerators having rotating doors including the side-by-side refrigerator and the French door refrigerator.

Technical Solution

Therefore, it is an aspect of the present invention to provide a refrigerator having a door rotatably hinged to a body of the refrigerator to prevent droop of the door.

It is another aspect of the present invention to provide a refrigerator preventing droop of the door thereof and degradation of the aesthetic quality of the external appearance thereof.

It is another aspect of the present invention to provide a method of manufacturing a refrigerator preventing droop of the door thereof.

Additional aspects of the invention will be set forth in part in the description which follows and, in part, will be obvious from the description, or may be learned by practice of the invention.

In accordance with one aspect of the present invention, a refrigerator includes a body provided with an inner case and an outer case, a storage compartment formed in the body and provided with a front surface, a top surface, a bottom surface and opposite lateral surfaces, the front surface being open to place or withdraw food, a pair of doors to open and close the front surface of the storage compartment, each of the doors being provided with a dyke protruding rearward, a gasket provided on a rear surface of each of the doors to seal a gap between the body and the doors, an upper hinge and a lower hinge connected to one side of each of the doors to support the doors such that the doors are rotatable with respect to the body, and a roller positioned at a side opposite to the side of a corresponding one of the doors having the upper hinge and the lower hinge connected thereto, with respect to a median plane of the corresponding one of the doors, and arranged at the dyke to be supported by the bottom surface of the storage compartment.

The roller may be positioned in the storage compartment when the doors are closed.

The dyke may include a pair of vertical pocket mounting portions allowing a door pocket to store food to be mounted thereto, and an extension portion to connect lower ends of the pocket mounting portions to each other, wherein the roller is arranged at the extension portion.

The refrigerator may further include a gasket installed at front, rear, left and right edges of the rear surface of each of the doors.

A part of the roller may be accommodated in the dyke, and the other part of the roller is exposed to an outside of the dyke.

The refrigerator may further include a roller cap connected to the dyke to be fixed and allowing the roller to be rotatably mounted thereto.

The roller cap may include a base and a cap portion protruding from the base to form a roller accommodation space to accommodate a part of the roller and inserted into the dyke.

The roller cap includes at least one coupling projection coupled to the dyke.

The roller cap may include a shaft accommodation portion to accommodate a rotating shaft of the roller.

The refrigerator may further include a reinforcement plate coupled to the bottom surface to increase rigidity.

The reinforcement plate may be not integrated with the inner case, but separately formed and coupled to the inner case.

The bottom surface may be provided with an installation groove allowing the reinforcement plate to be coupled thereto, and when the reinforcement plate is coupled to the installation groove, the reinforcement plate may not protrude from the bottom surface, but form the same horizontal plane together with the bottom surface.

The reinforcement plate may be formed of a steel material.

In accordance with another aspect of the present invention, a refrigerator includes a body provided with an inner case and an outer case, a storage compartment formed in the body and provided with a front surface, a top surface, a bottom surface and opposite lateral surfaces, a door to open and close the open front surface of the storage compartment, and an upper hinge and a lower hinge connected to one side of the door, with respect to a median plane of the door, to support the doors such that the doors are rotatable with respect to the body, wherein the door includes a front panel, a rear panel, a left frame, a right frame, an upper cap, a lower cap, and insulation foamed and hardened in the door, wherein the rear panel includes a dyke protruding rearward to form a dyke forming surface to form the dyke, together with the insulation, wherein the dyke is provided with a roller positioned at the other side of the door with respect to the median plane of the door, and supported by the bottom surface of the storage compartment when the door is closed.

The dyke forming surface may be provided with an opening, and the a part of the roller is inserted into the dyke through the opening.

The refrigerator may further include a roller cap coupled to the dyke to seal the opening and allowing the roller to be rotatably mounted thereto.

The roller cap may include a base, and a sealing portion protruding from an edge of the base to closely contact the dyke forming surface.

In accordance with another aspect of the present invention, a method of manufacturing a refrigerator including a body provided with an inner case and an outer case, a storage compartment formed in the body and a door to open and close the open front surface of the storage compartment, includes temporarily combining a front panel of the door, a rear panel of the door provided with a dyke forming surface and an opening formed on the dyke forming surface, a left frame and a right frame of the door, an upper cap and a lower cap of the door, coupling a roller cap to the dyke forming surface to seal the opening, rotatably mounting the roller to the roller cap, introducing an undiluted urethane foam solution into an inner space formed by the front panel, the rear panel, the left frame, the right frame, the upper cap and the lower cap and foaming and hardening the same, and combining the front panel, the rear panel, the left frame, the right frame, the upper cap and the lower cap through adhesiveness of the undiluted urethane foam solution.

The method may include coupling a reinforcement plate to the bottom surface. g tube is heat-exchanged through all of the heat-exchanging fins.

Advantageous Effects

A refrigerator according to the present invention has a door rotatably coupled to one side of the body of the refrigerator through hinges with respect to a center line of the door, and is provided with a roller at the other side of the body with respect to the center line of the door. Accordingly, droop of the door may be prevented when the door is closed.

Since the roller is provided at a dyke formed on the rear surface of the door, it may be supported by the bottom surface of the storage compartment without a separate support structure to support the roller, and may be positioned in the storage compartment when the door is closed. Therefore, degradation of the external appearance of the refrigerator may be prevented.

In addition, since a part of the roller is accommodated in the dyke, and only the other part of the roller is exposed to the outside of the dyke, decrease of a storage space of the storage compartment due to disposition of the roller may be minimized.

Here, the space to accommodate a part of the roller is provided not by being integrally formed during fabrication of a rear panel of the door, but by connecting a separate roller cap having a space to accommodate the roller to the rear panel. Therefore, the roller may be easily mounted to the door to have a part of the roller accommodated in the dyke.

DESCRIPTION OF DRAWINGS

These and/or other aspects of the disclosure will become apparent and more readily appreciated from the following description of the embodiments, taken in conjunction with the accompanying drawings of which.

MODE FOR INVENTION

Figure 1:
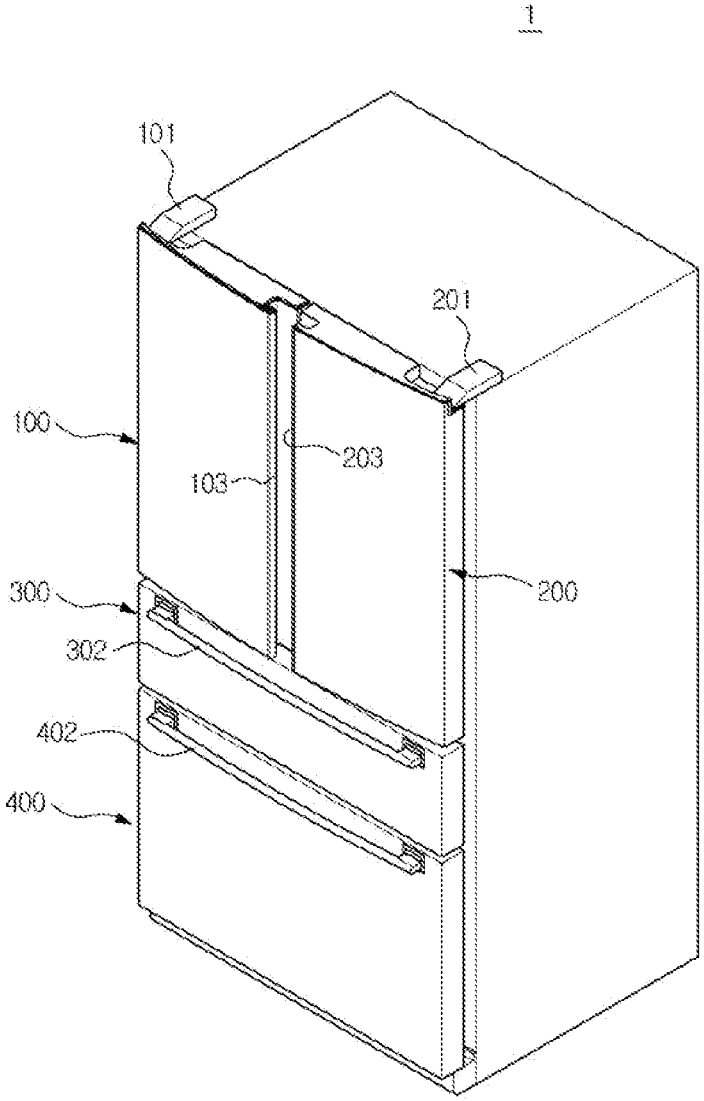
FIG. 1 is a view illustrating the external appearance of a refrigerator according to an exemplary embodiment of the present invention.

Reference will now be made in detail to the embodiments of the present invention, examples of which are illustrated in the accompanying drawings, wherein like reference numerals refer to like elements throughout.

Figure 2:
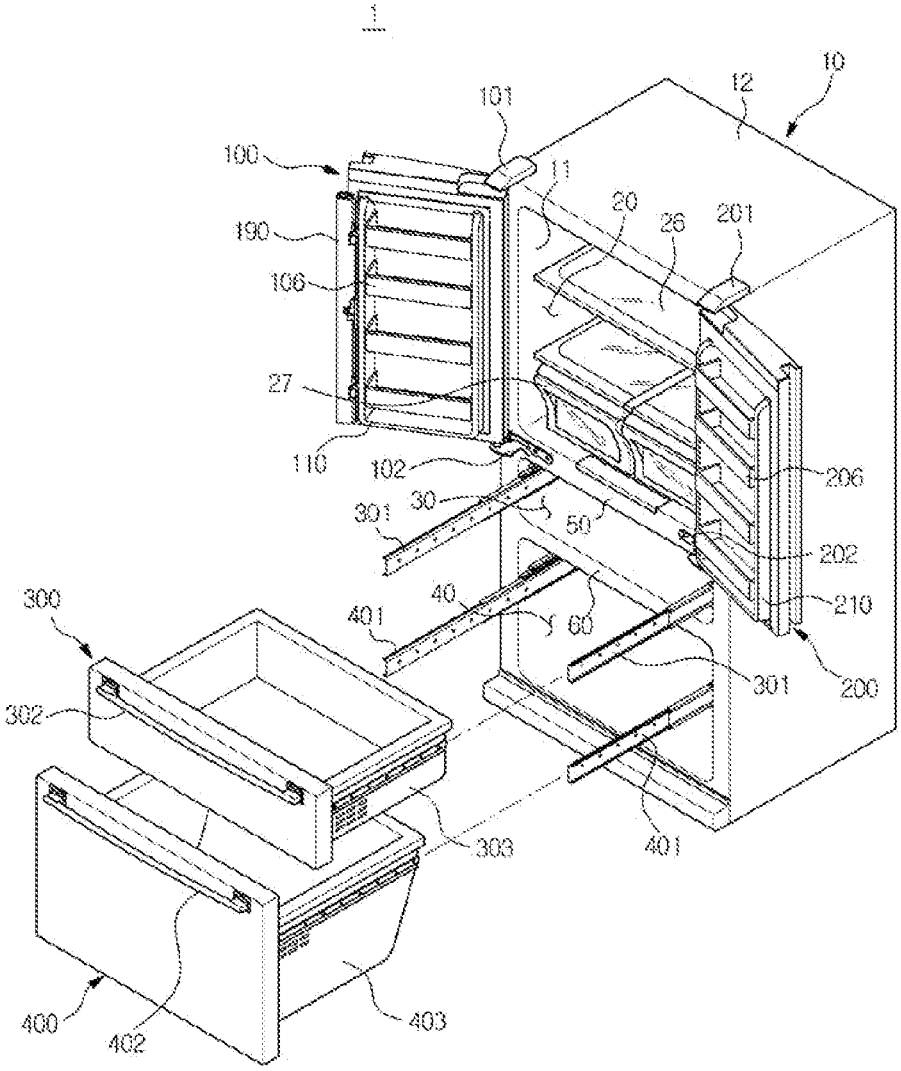
FIG. 2 is a view illustrating the refrigerator of FIG. 1 with the doors open.
Figure 3:
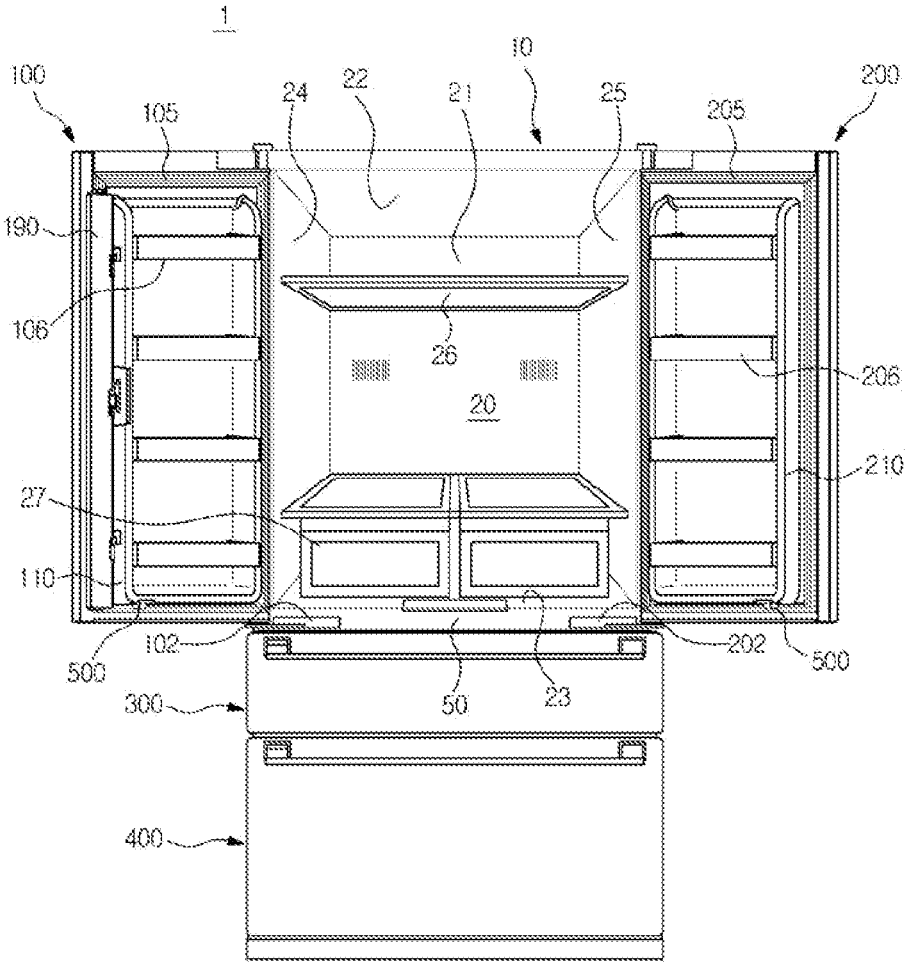
FIG. 3 is a front view illustrating an upper storage compartment of the refrigerator of FIG. 1.

FIG. 1 is a view illustrating the external appearance of a refrigerator according to an exemplary embodiment of the present invention, FIG. 2 is a view illustrating the refrigerator of FIG. 1 with the doors open, and FIG. 3 is a front view illustrating an upper storage compartment of the refrigerator of FIG. 1.

Referring to FIGS. 1 to 3, a refrigerator 1 includes a body 10, storage compartments 20, 30 and 40 formed in the body 10, and a cool air supply unit (not shown) to provide cool air to the storage compartments 20, 30 and 40.

The body 10 includes an inner case 11 to define the storage compartments 20, 30 and 40, an outer case 12 coupled to the outside of the inner case 11 to define an external appearance, and thermal insulation disposed between the inner case 11 and the outer case 12 to insulate the storage compartments 20, 30 and 40.

The inner case 11 may be formed of a resin material, and the outer case 12 may be formed of a metallic material which provides durability and aesthetic quality. Urethane may be used as an insulation material, and the insulation may be formed by foaming and hardening an undiluted urethane foam solution in the space between the inner case 11 and the outer case 12 after the inner case 11 and the outer case 12 are coupled to each other.

According to another aspect, the body 10 may include a top wall, a bottom wall, opposite sidewalls, a rear wall, and intermediate walls 50 and 60. The intermediate walls 50 and 60 may include a first intermediate wall 50 to separate the upper storage compartment 20 from the intermediate storage compartment 30, and a second intermediate wall 60 to separate the intermediate storage compartment 30 from the lower storage compartment 40. Insulation may be provided inside the intermediate walls 50 and 60 to insulate the storage compartments 20, 30 and 40.

Each of the storage compartments 20, 30 and 40 may be respectively used as a freezer compartment to keep food frozen at about −20° C. or a refrigeration compartment to keep food at a temperature between about 0° C. and +3° C.

The front of the storage compartments 20, 30 and 40 is open to allow food to be put in or withdrawn, and the open front may be opened and closed by doors 100, 200, 300 and 400. The upper storage compartment 20 may be opened and closed by a pair of rotating doors 100 and 200, and the intermediate storage compartment 30 and the lower storage compartment 40 may be respectively opened and closed by sliding doors 300 and 400.

The rotating doors 100 and 200 may be rotatably hinged to the body 10 by upper hinges 101 and 201 and lower hinges 102 and 202. Here, the upper hinges 101 and 201 and the lower hinges 102 and 202 may be respectively connected to upper and lower portions of one side of the rotating doors 100 and 200 with respect to median planes of the rotating doors 100 and 200.

Accordingly, the rotating doors 100 and 200 are rotatable about an axis of rotation formed at one side with respect to the median planes, and may be supported by the upper hinges 101 and 201 and the lower hinges 102 and 202 connected to one side with respect to the median planes.

The sliding doors 300 and 400 are slidably coupled to the boy 10 by sliding units 301 and 401. The doors 100, 200, 300 and 400 may be provided with knobs 103, 203, 302 and 402.

Door pockets 106 and 206 to store food may be mounted to the rear surfaces of the rotating doors 100 and 200, and baskets 303 and 403 to store food may be provided at the rear surfaces of the sliding doors 300 and 400.

The cool air supply unit includes a compressor, a condenser, an expansion valve, an evaporator, a refrigerant tube, and a fan, and may produce cool air by refrigeration cycle of compression, condensation, expansion and evaporation of a refrigerant.

As shown in FIG. 3, the upper storage compartment 20 is provided with a rear surface 21, a top surface 22, a bottom surface 23, a left surface 24 and a right surface 25, and may be provided with a storage space formed therein.

The storage space may be provided with a shelf 26 allowing food to be placed thereon, and a sealing box 27 to store fish or vegetables in a sealed state.

As described above, the rotating doors 100 and 200 to open and close the upper storage compartment 20 are supported by the upper hinges 101 and 201 and the lower hinges 102 and 202 respectively connected to the upper and lower portions of one side with respect to the median plane, and thus the other side with respect to the median plane may droop due the weight of the rotating doors 100 and 200, or the weight of food stored in the door pockets 106 and 206.

A refrigerator according to one embodiment of the present invention is provided, at the other side with respect to the median plane, with rollers 500 to support the rotating doors 100 and 200 so as to prevent droop of the rotating doors 100 and 200.

The rollers 500 are arranged at the lower portions of the rear surfaces of the rotating doors 100 and 200. The rollers 500 are arranged at the dykes 110 and 210 protruding from the rear surfaces of the rotating doors 100 and 200. When the rotating doors 100 and 200 are closed, the rollers 500 are supported by the bottom surface 23 of the upper storage compartment 20 and positioned inside the upper storage compartment 20.

Accordingly, the rollers 500 are not exposed to the outside when the rotating doors 100 and 200 are left closed. Thereby, the rollers may support the rotating doors 100 and 200 to balance the both sides of the rotating doors 100 and 200 without affecting the external appearance of the refrigerator.

Further, the rollers 500 are arranged such that some portions thereof is accommodated in dykes 110 and 210, and thereby the external appearance of the rotating doors 100 and 200 may be enhanced and encroachment on the storage space of the upper storage compartment 20 by the rollers 500 may be minimized.

Figure 4:
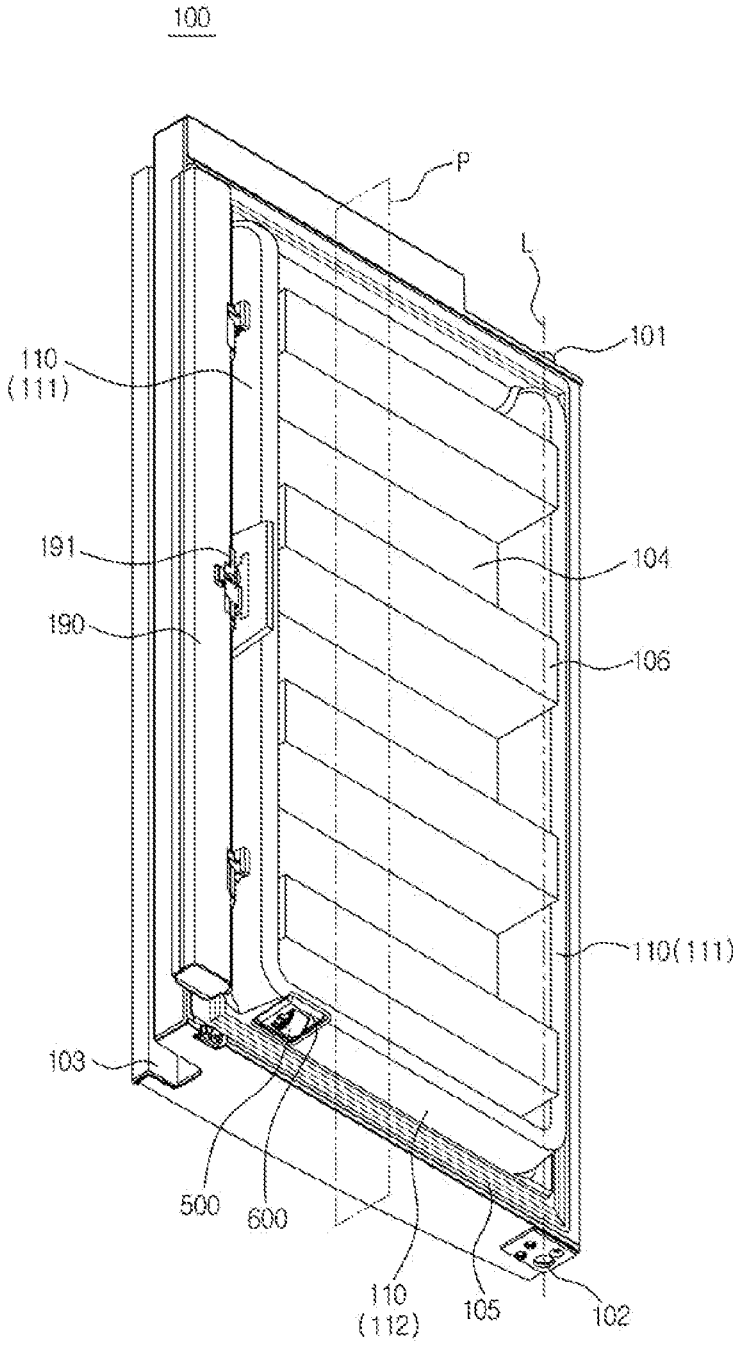
FIG. 4 is a view illustrating the external appearance of a door of the refrigerator of FIG. 1.

In addition, coupling of the rollers 500 to the dykes 110 and 210 to make some portions of the rollers 500 accommodated in the dykes 110 and 210 may be easily realized through roller caps 600 (FIG. 4).

Hereinafter, the structures of the rollers 500 and roller caps 600 of the refrigerator according to the one embodiment of the present invention, connection thereof to the rotating doors 100 and 200 will be described in detail.

Figure 5:
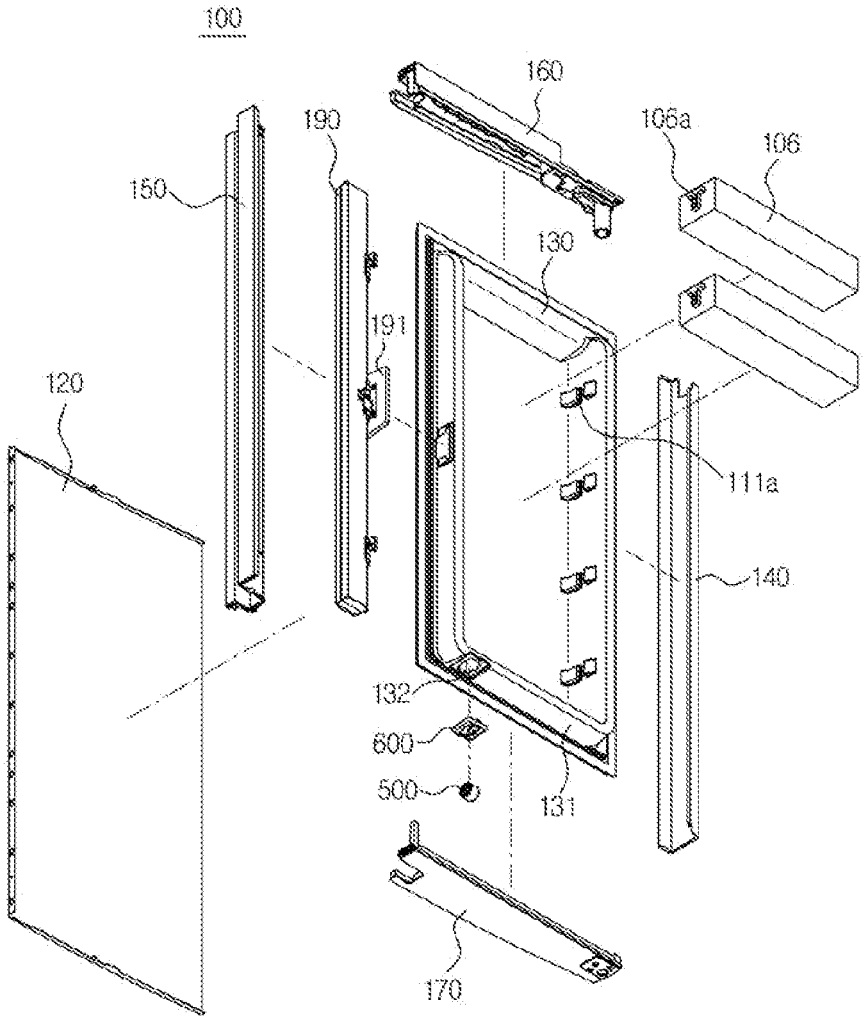
FIG. 5 is an exploded perspective view illustrating the door of the refrigerator in FIG. 1.
Figure 6:
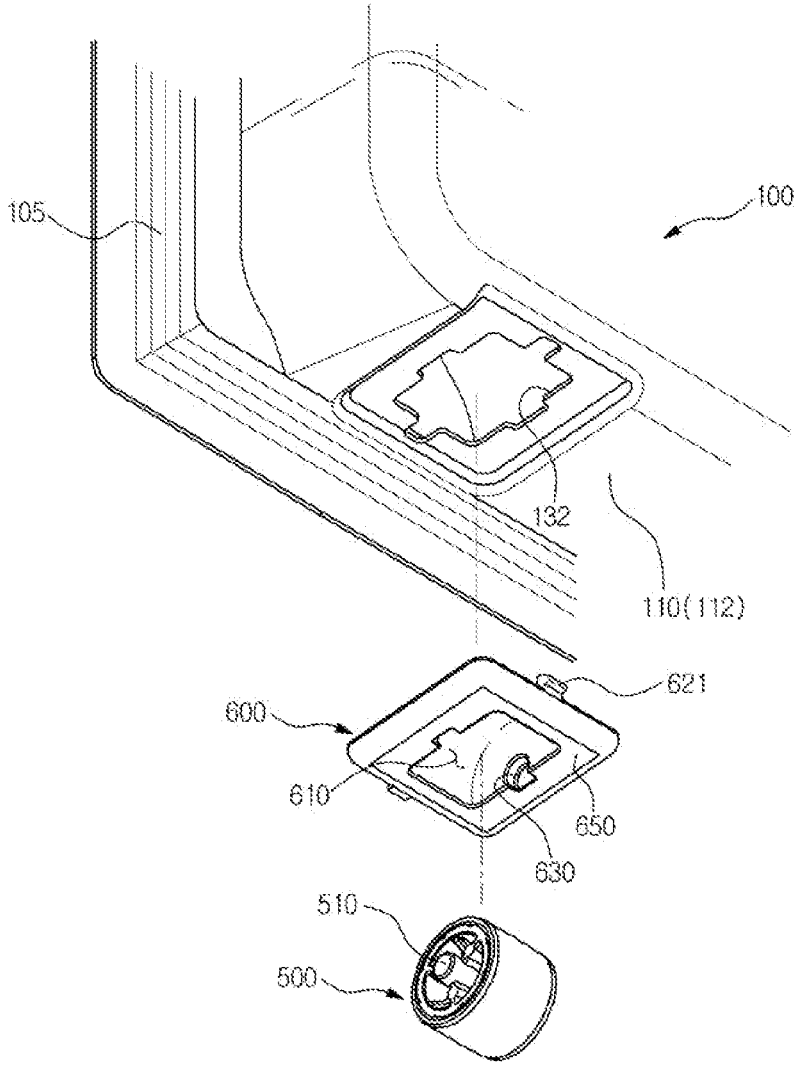
FIG. 6 is a view illustrating a roller and a roller cap of the refrigerator of FIG. 1.
Figure 7:
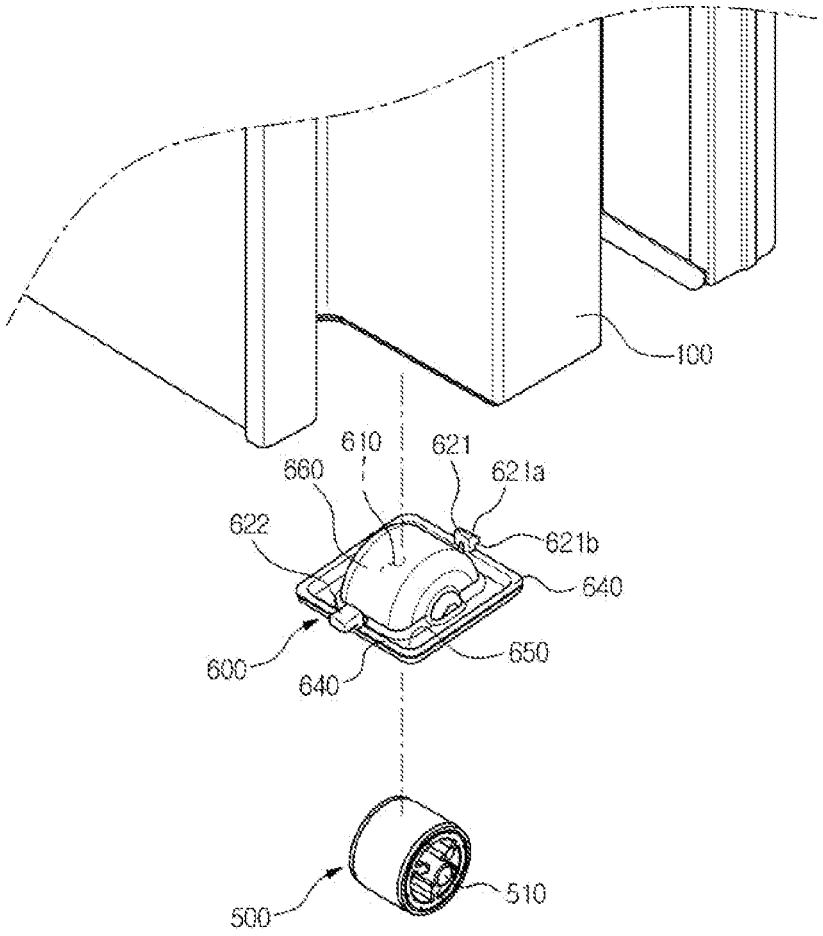
FIG. 7 is a view illustrating the roller and roller cap of the refrigerator of FIG. 1, which is seen from a different angle.
Figure 8:
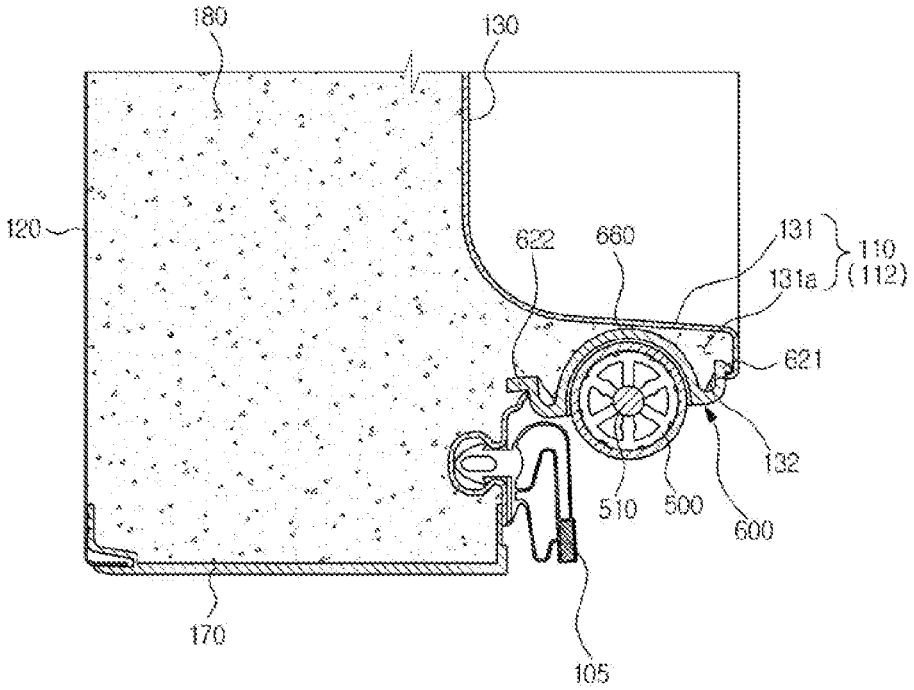
FIG. 8 is a cross-sectional view illustrating the refrigerator of FIG. 1.
Figure 9:
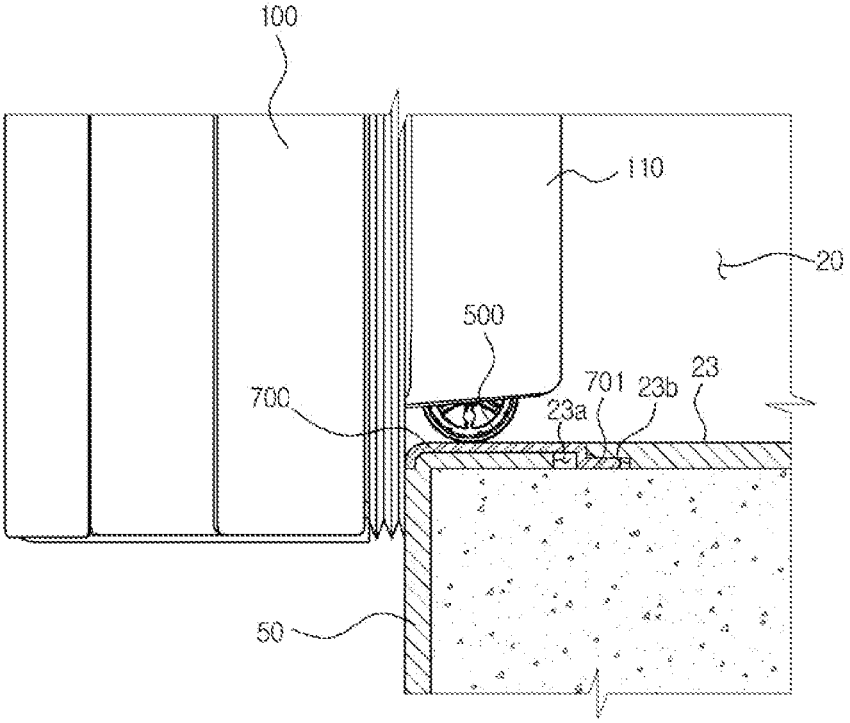
FIG. 9 is a side view illustrating the refrigerator of FIG. 1.
Figure 10:
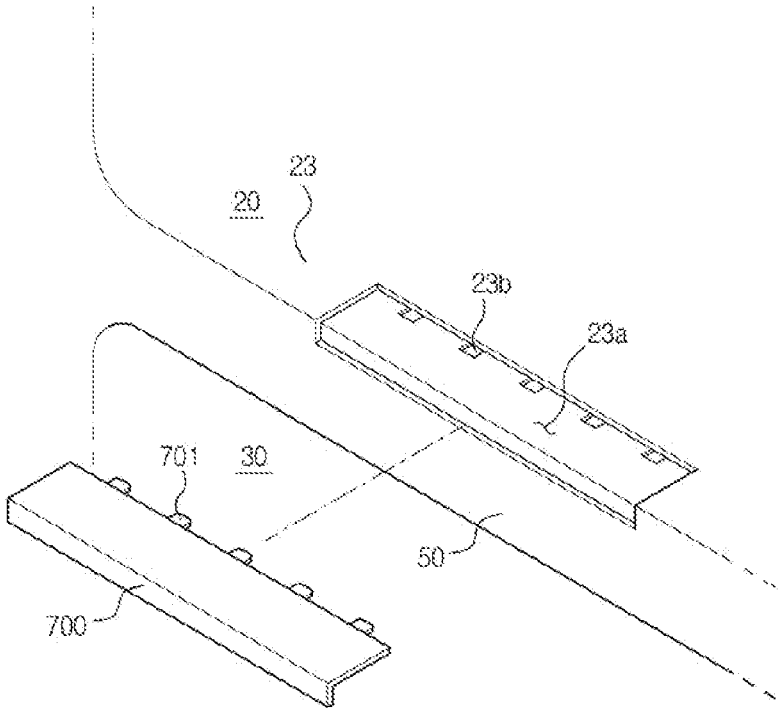
FIG. 10 is a view illustrating a reinforcement plate to support the rollers of the refrigerator of FIG. 1.

FIG. 4 is a view illustrating the external appearance of a door of the refrigerator of FIG. 1, and FIG. 5 is an exploded perspective view illustrating the door of the refrigerator in FIG. 1. FIG. 6 is a view illustrating a roller and a roller cap of the refrigerator of FIG. 1, and FIG. 7 is a view illustrating the roller and roller cap of the refrigerator of FIG. 1, which is seen from a different angle. FIG. 8 is a cross-sectional view illustrating the refrigerator of FIG. 1, and FIG. 9 is a side view illustrating the refrigerator of FIG. 1. FIG. 10 is a view illustrating a reinforcement plate to support the rollers of the refrigerator of FIG. 1.

The structures of the rollers 500 and roller caps 600 of the refrigerator according to the one embodiment of the present invention, connection thereof to the rotating doors 100 and 200 will be described in detail with reference to FIGS. 4 to 10. Since the structure of the right rotating door 200 is symmetrical to that of the left rotating door 100, description will be given only of the left rotating door 100, and description of the right rotating door 200 will be omitted. Also, for convenience of description, the rotating door 100 will be referred to as a door and the upper storage compartment 20 will be referred to as a storage compartment.

As shown in FIG. 4, the upper hinge 101 and the lower hinge 102 may be connected to the upper and lower portions of one side of the door 100 with respect to the median plane P, and the door 100 may be rotatable about the axis of rotation L formed at the one side with respect to the median plane P.

The front surface of the door 100 may be provided with a knob 103, and a gasket 105 may be installed at the rear surface 104 of the door 100 to closely contact the body 10 to seal the storage compartment when the door 100 is closed. The gasket 105 may be installed at the front, rear, left and right edges of the rear surface 104 of the door 100.

The rear surface 104 of the door 100 may be provide with a dyke 110 protruding therefrom to allow the door pocket 106 and a filler 190 to be installed. The door pocket 106 allows food to be store therein. The filler 190 may seal the gap between the rotating doors 100 and 200 when the rotating doors 100 and 200 are all closed.

The dyke 110 may be positioned at the inside of the gasket 105. The dyke 110 may be positioned in the storage compartment when the door 100 is closed. The dyke 110 may include a pair of pocket mounting portions 111 arranged parallel to each other in the approximately vertical direction to mount the door pocket 106 thereto, and an extension portion 112 to connect the lower ends of the pocket mounting portions 111.

The pocket mounting portion 111 may be provided with a pocket coupling groove 111 a allowing the door pocket 106 to be mounted thereto, and the door pocket 106 may be provided with a pocket coupling protrusion 106*a* fitted into the pocket coupling grooves 111*a*. A coupling bracket 191 to rotatably support the filler 190 may be coupled to the pocket mounting portion 111.

Meanwhile, the roller 500 to support the door 100 is provided at the extension portion 112. With respect to the median plane P of the door 100, the roller 500 is arranged at the other side opposite to the side at which the axis of rotation L is formed. Since the dyke 110 is adapted to be positioned in the storage compartment when the door 100 is closed, the roller 500 provided at the dyke 110 may also be positioned in the storage compartment when the door 100 is closed.

The roller 500 as above may be supported by the bottom surface 23 of the storage compartment 20 when the door 100 is closed, as shown in FIG. 9. Accordingly, a separate structure to support the roller 500 may not need to be provided for the body.

In addition, as shown in FIGS. 8 and 9, a part of the roller 500 is accommodated in the dyke 110, and only the other part of the roller 500 is exposed to the outside of the dyke 110. Thereby, the external appearance of the door 100 may be improved, and encroachment on the storage space of the storage compartment 20 by the roller 500 may be minimized.

A roller cap 600 to mount the roller 500 may be coupled to the dyke 110. The roller cap 600 facilitates mounting the roller 500 to the dyke 110, and allows a part of the roller 500 to be accommodated in the dyke 110. A detailed description of the roller cap 600 will be given later.

Another aspect of the structures of the rollers 500 and roller caps 600 of the refrigerator according to the illustrated embodiment and connection thereof to the rotating doors 100 and 200 will be described with reference to FIG. 5.

The door 100 include a front panel 120 forming a front surface of the door 100, a rear panel 130 forming the rear surface 104 of the door 100, a left frame 140 forming the left lateral surface of the door 100, a right frame 150 forming the right lateral surface of the door 100, an upper cap 160 forming the top surface of the door 100, and a lower cap 170 forming the bottom surface of the door 100, which are connected to each other.

A foaming space is formed by the front panel 120, the rear panel 130, the left frame 140, the right frame 150, the upper cap 160 and the lower cap 170, and insulation may be disposed in the foaming space.

The front panel 120, the rear panel 130, the left frame 140, the right frame 150, the upper cap 160 and the lower cap 170 may be temporarily connected to each other using a fixing jig or through fitting structures thereof.

When an undiluted urethane foam solution is introduced into the foaming space, and foamed and hardened therein after the temporary connection, the front panel 120, the rear panel 130, the left frame 140, the right frame 150, the upper cap 160 and the lower cap 170 may be firmly connected to each other by the adhesiveness of the urethane foam solution.

At this time, the rear panel 130 is provided with a dyke forming surface 131 protruding rearward to form the dyke 110 in addition to the insulation 180 formed by foaming and hardening the urethane foam solution, as shown in FIG. 8. The dyke forming surface 131 forms the external appearance of the dyke 110. A filling space 131*a* in which the urethane foam solution is foamed and hardened is provided in the dyke forming surface 131.

An opening 132 is formed at the lower portion of the dyke forming surface 131. A part of the roller 500 may be inserted into the dyke 110 through the opening 132. The part of the roller 500 is not directly inserted into the dyke 110 through the opening 132, but the roller cap 600 is inserted into the dyke 110 instead of the roller 500, and the roller 500 may be rotatably mounted to the roller cap 600.

As shown in FIGS. 6 and 7, the roller cap 600 may include a base 650, a cap potion 660 protruding from the base 650 and inserted into the dyke 110 to form a roller accommodation space 610, a shaft accommodation portion 630 in which a rotating shaft 510 of the rollers 500 is rotatably accommodated, a sealing portion 640 protruding from the base 650 to closely contact the dyke forming surface 131 to seal the opening 132, and coupling projections 621 and 622 to be coupled to the dyke 110.

A part of the roller 500 may be accommodated in the roller accommodation space 610. The sealing portion 640 may be formed to protrude from the edge of the base 650.

The roller cap 600 may be coupled to the dyke 110 in the direction from the outside of the dyke 110 to the inside of the dyke 110. That is, it may be moved upward to be coupled to the dyke 110. When the roller cap 600 is coupled to the dyke 110, the cap portion 660 may be inserted into the dyke 110 through the opening 132.

The coupling projections 621 and 622 may include a first coupling projection 621 and a second coupling projection 622 which protrude in the opposite directions. The first coupling projection 621 may be formed of an elastic material.

When coupled to the dyke 110 in the direction from the outside of the dyke 110 to the inside of the dyke 110, the first coupling projection 621 and the second coupling projection 622 may be inserted into the dyke 110 through the opening 132.

The first coupling projection 621 may include a slope 621 a formed to be inclined, and a support surface 621*b* extending horizontally from the slope 621*b* to be parallel with the dyke forming surface 131 in order to support the roller cap 600 by being intervened by the inner surface of the dyke forming surface 131 when the first coupling projection 621 is inserted into the dyke 110.

When the roller cap 600 enters the dyke 110 from the outside, the slope 621 a of the first coupling projection 621 is pressed by the outer surface of the dyke forming surface 131 around the opening 132 to cause the first coupling projection 621 to be deformed inward to some extent and inserted into the dyke 110. When the insertion of the first coupling projection 621 is completed, the first coupling projection 621 recovers its original shape through an elastic force, and the support surface 621*b* is supported by the inner surface of the dyke forming surface 131, thereby allowing the roller cap 600 to be coupled to the dyke 110.

As the cap portion 660 is accommodated in the dyke 110, a part of the roller 500 accommodated in the roller accommodation space 650 formed by the cap portion 660 is also accommodated in the dyke 110.

It is not easy to fabricate the rear panel 130 in a mold such that the dyke 10 has a hole to accommodate a part of the roller 500. Accordingly, mounting the roller 500 to the dyke 110 with a part of the roller 500 accommodated in the dyke 110 may be realized by fabricating the rear panel 130 to provide an opening 132 in the dyke forming surface 131, coupling the roller cap 600 having the roller accommodation space 610 to accommodate a part of the roller 500 to the dyke 110, and then mounting the roller 500 to the roller accommodation space 610.

Since the opening 132 is sealed by coupling the roller cap 600 to the dyke 110 as described above, the door 100 may be manufactured by temporarily connecting the front panel 120, the rear panel 130, the left frame 140, the right frame 150, the upper cap 160 and the lower cap 170 to each other, sealing the opening 132 through coupling of the roller cap 600 to the dyke 110, and then foaming and hardening an undiluted urethane foam solution in the inside of the door 100.

FIG. 10 is a view illustrating a reinforcement plate to support the rollers of the refrigerator of FIG. 1.

Referring to FIG. 10, the refrigerator according to the illustrated embodiment may further include a reinforcement plate 700 connected to the bottom surface 23 of the storage compartment 20 which supports the roller 500.

The inner case 11 forming the bottom surface 23 of the storage compartment 20 is generally formed of a resin material. Thereby, as the refrigerator continues to be used for a long time, the bottom surface 23 that supports the roller 500 may be deformed by pressure applied by the roller 50 or damage to the bottom surface 23 such as a scratch may occur due to friction between the bottom surface 23 and the roller 500.

To prevent deformation and damage as above, the reinforcement plate 700 is connected to the bottom surface 23 of the storage compartment 20 by which the roller 500 is supported and contacted to create friction.

The reinforcement plate 700 may be formed of a material such as steel which has high rigidity. The reinforcement plate 700 may be installed at a part of the bottom surface 23 of the storage compartment 20 corresponding to the position of the roller 500. The reinforcement plate 700 may be installed at the center of the front portion of the bottom surface 23 of the storage compartment 20.

The bottom surface 23 of the storage compartment 20 may be provided with an installation groove 23*a* at which the reinforcement plate 700 is installed. When the reinforcement plate 700 is connected to the installation groove 23*a*, it may not protrude from the bottom surface 23 but may form a horizontal plane on the same level with the bottom surface 23.

The reinforcement plate 700 may be provided with a fitting projection 701, and the bottom surface 23 may be provided with a fitting groove 23*b* allowing the fitting projection 701 to be fitted thereinto. The reinforcement plate 700 may be fabricated separately from the inner case 11 and connected to the inner case 11 before or after coupling between the inner case 11 and the outer case 12.

A French door refrigerator having 3 storage compartments among which the two upper storage compartments are opened and closed by a pair of rotating doors has been described above as an example. However, the spirit of the present invention is not limited thereto, but applicable to any type of refrigerator having rotating doors.

The invention claimed is:

1. A refrigerator comprising:

a body provided with an inner case and an outer case;

a storage compartment formed in the body by the inner case and provided with a front surface, a top surface, a bottom surface and opposite lateral surfaces, the front surface being open to place or withdraw food;

a pair of doors to open and close the open front surface of the storage compartment, each of the doors being provided with a dyke protruding rearward, the dyke comprising a pair of vertical pocket mounting portions and an extension portion to connect lower ends of the pocket mounting portions to each other;

a gasket provided on a rear surface of each of the doors to seal a gap between the body and the doors;

an upper hinge and a lower hinge connected to one side of each of the doors to support the doors such that the doors are rotatable with respect to the body;

a roller positioned at a side of a corresponding one of the doors that is opposite to the one side of the corresponding one of the doors having the upper hinge and the lower hinge connected thereto, with respect to a median plane of the corresponding one of the doors;

a roller cap connected to an opening of the dyke, the roller being rotatably mounted to the roller cap; and a separately formed reinforcement plate coupled to a bottom surface of the inner case inside the storage compartment to increase rigidity, the reinforcement plate being separately formed and coupled to the inner case, and not integrally formed with the inner case, wherein the roller is arranged in the extension portion of the dyke and supported by the reinforcement plate coupled to the bottom surface of the storage compartment, a top part of the roller being accommodated inside the dyke, and a bottom part of the roller being exposed through a lowermost surface of the dyke, the roller cap includes a base and a sealing portion protruding from the base to closely contact the dyke to seal the opening, and the bottom surface of the inner case includes an installation groove coupled to the reinforcement plate, whereby when the reinforcement plate is coupled to the installation groove, the reinforcement plate does not protrude from the bottom surface of the inner case, but forms a same horizontal plane together with the bottom surface of the inner case.

2. The refrigerator according to claim 1, wherein the roller is positioned in the storage compartment when the doors are closed.

3. The refrigerator according to claim 1, further comprising a gasket installed at upper, lower, left and right edges of the rear surface of each of the doors.

4. The refrigerator according to claim 1, wherein the roller cap comprises a cap portion protruding from the base to form a roller accommodation space to accommodate a part of the roller and inserted into the dyke.

5. The refrigerator according to claim 1, wherein the roller cap comprises at least one coupling projection coupled to the dyke.

6. The refrigerator according to claim 1, wherein the roller cap comprises a shaft accommodation portion to accommodate a rotating shaft of the roller.

7. The refrigerator according to claim 1, wherein the reinforcement plate is formed of a steel material.

* * * * *